US007291401B2

(12) United States Patent
Suzuki et al.

(10) Patent No.: US 7,291,401 B2
(45) Date of Patent: Nov. 6, 2007

(54) NON-HEXAVALENT-CHROMIUM TYPE CORROSION RESISTANT COATING FILM STRUCTURE HAVING A RESIN LAYER AND A METAL LAYER THAT IS SUPERIOR IN TERMS OF ADHESION TO THE RESIN LAYER

(75) Inventors: Kazuo Suzuki, Sunto-gun (JP); Iyoshi Watanabe, Numazu (JP)

(73) Assignee: USUI Kokusai Sangyo Kabushiki Kaisha, Ltd., Shizuoka (JP)

( * ) Notice: Subject to any disclaimer, the term of this patent is extended or adjusted under 35 U.S.C. 154(b) by 0 days.

(21) Appl. No.: 10/486,667

(22) PCT Filed: Sep. 4, 2002

(86) PCT No.: PCT/JP02/08992

§ 371 (c)(1),
(2), (4) Date: Feb. 11, 2004

(87) PCT Pub. No.: WO03/029520

PCT Pub. Date: Apr. 10, 2003

(65) Prior Publication Data

US 2004/0197594 A1 Oct. 7, 2004

(30) Foreign Application Priority Data

Sep. 5, 2001 (JP) ..... 2001-268334

(51) Int. Cl.
*B32B 15/04* (2006.01)
*B32B 15/18* (2006.01)
*B32B 15/20* (2006.01)

(52) U.S. Cl. ..... 428/626; 428/681; 428/684; 428/680; 428/674; 428/676; 428/666

(58) Field of Classification Search ..... 428/681, 428/684, 687, 680, 674, 676, 677, 666, 667, 428/657, 658, 457, 626, 469, 472
See application file for complete search history.

(56) References Cited

U.S. PATENT DOCUMENTS

| | | | | |
|---|---|---|---|---|
| 4,359,345 | A | 11/1982 | Da Fonte, Jr. | 148/6.2 |
| 4,707,415 | A * | 11/1987 | Ikeda et al. | 428/621 |
| 4,985,311 | A * | 1/1991 | Shindou et al. | 428/623 |
| 6,235,407 | B1 * | 5/2001 | Ogata et al. | 428/626 |
| 6,500,565 | B2 * | 12/2002 | Usui | 428/623 |
| 6,866,944 | B2 * | 3/2005 | Nakazawa et al. | 428/626 |
| 2001/0029990 | A1 * | 10/2001 | Takahashi et al. | 138/146 |
| 2002/0090528 | A1 * | 7/2002 | Usui | 428/623 |

FOREIGN PATENT DOCUMENTS

| | | | |
|---|---|---|---|
| GB | 2 292 699 | A * | 3/1996 |
| JP | 61-227181 | | 10/1986 |
| JP | 63-243282 | | 10/1988 |
| WO | WO 01/86020 | A1 * | 11/2001 |

* cited by examiner

*Primary Examiner*—Michael E. Lavilla
(74) *Attorney, Agent, or Firm*—Koda & Androlia

(57) ABSTRACT

A steel material that has on its surface a non-hexavalent-chromium type corrosion-resistant coating film formed by a composite of a metal layer and a resin layer. The steel material having or not having a copper layer is formed with 1) a Zn and/or Zn-based alloy layer, 2) a Zn/Ni alloy layer which is on this Zn and/or Zn-based alloy layer, 3) a de-Zn layer which is on the Zn/Ni alloy layer and is obtained by chemically treating the surface of the Zn/Ni alloy layer, and 4) at least one resin covering layer which is on this de-Zn layer, which are successively formed to make a corrosion-resistant coating film, the corrosion-resistant coating film, which is superior in adhesion between the metal layer and resin layer, being obtained by way of taking into account the use of a trivalent chromium type chromate layer instead of a hexavalent chromium type chromate layer (which is a substance that places a burden on the environment).

6 Claims, No Drawings

NON-HEXAVALENT-CHROMIUM TYPE CORROSION RESISTANT COATING FILM STRUCTURE HAVING A RESIN LAYER AND A METAL LAYER THAT IS SUPERIOR IN TERMS OF ADHESION TO THE RESIN LAYER

TECHNICAL FIELD

The present invention relates to a non-hexavalent-chromium type corrosion-resistant coating film structure which is superior in terms of corrosion resistance and has on a surface of a steel material a resin layer and a metal layer that is superior in terms of adhesion to the resin layer, in which the use of hexavalent chromium which is a substance that places a burden on the environment is avoided.

More specifically, the present invention relates to a steel material having a non-hexavalent-chromium type corrosion-resistant coating film structure which, without the use of hexavalent chromium (a substance that places a burden on the environment), is superior in terms of corrosion resistance, the steel material having on its surface a novel coating film structure which includes a resin layer and a metal layer that shows superior adhesion with respect to the resin layer, and the steel material being useful for the manufacture of metal pipes having a pipe diameter of 30 mm or less and used, for instance, for brake fluid and fuels in automobiles and for oil and air supply in various types of machinery, equipment, etc.

BACKGROUND ART

In the past, there are many proposals for improving the corrosion resistance of steel materials by forming metal coating film layers and resin coating film layers on the surfaces of steel materials.

For instance, chromate layers formed by means of a chromate solution containing hexavalent chromium ions show superior anti-rust properties and adhesion (primary adhesion and secondary adhesion) to resin layers; and thus, the corrosion resistance of steel materials that have zinc type coating films has been improved by forming a composite coating film structure that includes a resin coating layer and a chromate layer containing hexavalent chromium on the surfaces of such steel materials that have zinc type coating films.

In the industry, as described above, desired metal layers, e.g., Zn plating layers (zinc type coating films) are formed between the surfaces of steel materials and the chromate layers from the standpoint of improving the corrosion resistance, etc.

However, hexavalent chromium type chromate layers contain a hexavalent chromium ion that is a substance which places a burden on the environment. Accordingly, the effect exerted on the environment when such steel materials are discarded is a social problem.

In European legal regulations (ELV order: End of Life Vehicle), a complete ban on the use of automobile parts that contain hexavalent chromium is planned to take effect in the year 2005.

As a response measure, the formation of chromate layers (hereafter referred to a trivalent chromate layers) that use a chromate solution consisting of trivalent chromium ions instead of hexavalent chromium has been practiced in order to suppress the burden on the environment.

For example, in corrosion-resistant pipe materials that have been proposed, a Zn plating layer is formed on at least the outer circumferential surface of the pipe material, a trivalent chromate layer is formed on top of this plating layer, and a resin covering layer consisting of a polyvinyl fluoride resin, etc., is formed on top of this chromate layer with a primer layer consisting of an epoxy resin, etc. being interposed.

However, in corrosion-resistant pipe materials in which a resin-covering layer is combined (formed as a composite) with a trivalent chromate layer instead of the hexavalent chromium layer, the adhesive strength between the trivalent chromate layer and resin layer is not very strong. Consequently:

- Both interfaces tend to peel as a result of end molding or bending of the pipe material (this characteristic will be described below as a characteristic that is associated with primary adhesion); and
- In automotive piping, in cases where damage is generated in the resin layer as a result of flying rocks or mud during operation of the vehicle, corrosive elements such as moisture or salts, etc., easily invade the interface between the resin layer and metal layer so that the corrosion rate is accelerated (this characteristic will be described below as a characteristic that is associated with secondary adhesion).

DISCLOSURE OF INVENTION

In primary terms, the present invention provides a technique for improving the adhesive force between the metal layer and resin layer (primary and secondary adhesive force) in a steel material having non-hexavalent-chromium type corrosion-resistant coating film structure which have a composite layer consisting of a metal layer and resin layer, and in which the formation of a hexavalent chromate layer (which places a great burden on the environment) has been abolished.

In secondary terms, furthermore, the present invention provides a technique for improving the adhesive force (primary and secondary adhesive force) between the metal layer and the resin layer in a steel material having a non-hexavalent-chromium type corrosion-resistant coating film structure in which even though a chromate layer is formed, this layer is formed as a trivalent chromate layer instead of a hexavalent chromate layer (which places a great burden on the environment), and in which the steel material has a composite layer consisting of a metal layer, trivalent chromium layer and resin layer.

In order to solve the above-described problems and improve the adhesive force between the upper resin layer and metal layer that forms the lower layer (in cases where no trivalent chromate layer is formed) or between the metal layer and the trivalent chromate layer (in cases where a trivalent chromate layer is formed), the present inventor believed that it is important to alter the surface (micro) structure of the metal layer that forms the under layer to a structure (structure with fine indentations and projections, fine groove structure or fine crack structure) that causes tight adhesion of the resin layer in terms of the joint and to subject the surface of the metal layer to further passivation (passive state) so that the corrosion rate is retarded.

As a result of diligent research conducted in the direction of the above-described research and development, the present inventor discovered that the surface structure of the uppermost layer of the metal layer that forms the under layer beneath the resin layer can be altered to a micro-structure that is suitable for achieving tight adhesion of the resin layer in terms of the joint (i.e., that is superior in terms of anchoring characteristics) by:

forming a de-Zn layer that has been subjected to passivation on the surface of a Zn/Ni alloy layer by the chemical treatment of this Zn/Ni alloy layer, or applying a chromate solution containing trivalent chromium ions to a Zn/Ni alloy layer, or forming a chemical (electroless) Ni plating layer on a Zn and/or Zn-based alloy layer, or applying a chromate solution containing trivalent chromium ions to the chemical (electroless) Ni plating layer.

The present invention was perfected on the basis of this finding.

By the present invention, a steel material with a composite coating film structure, which is superior in terms of the adhesive strength of the metal layer and resin layer (primary and secondary adhesive strength) and which is also superior in terms of corrosion resistance, can be economically provided in a non-hexavalent-chromium type corrosion-resistant steel material which has a composite layer consisting of a metal layer and a resin layer and in which the formation of a hexavalent chromate layer (which places a great burden on the environment) is abolished.

Furthermore, as a result of the present invention, a steel material with a composite coating film structure, which is superior in terms of the adhesive strength of the metal layer and resin layer with a trivalent chromate layer interposed (primary and secondary adhesive strength) and which is also superior in terms of corrosion resistance, can be economically provided in a non-hexavalent-chromium type corrosion-resistant steel material which has a composite layer consisting of a metal layer, a trivalent chromate layer and a resin layer and in which even though a chromate layer is formed, the hexavalent chromate layer (which places a great burden on the environment) is replaced by a trivalent chromate layer.

To describe the present invention in outline, the first aspect of the present invention is that it relates to a non-hexavalent-chromium type corrosion-resistant coating film structure which has a resin layer and a metal layer that is superior in terms of adhesion to the resin layer, and this structure is characterized in that:

a Zn/Ni alloy layer, a de-Zn layer which is positioned on top of the Zn/Ni alloy layer and which is obtained by chemically treating this Zn/Ni alloy layer, and at least one resin-covering layer positioned on top of this de-Zn layer, are successively formed on the surface of a steel material which is with or without (or which either has or does not have) a copper layer.

Furthermore, the second aspect of the present invention is that it relates to a non-hexavalent-chromium type corrosion-resistant coating film structure which has a resin layer and a metal layer that is superior in terms of adhesion to the resin layer, and this structure is characterized in that:

a Zn/Ni alloy layer, a trivalent chromate layer which is positioned on top of this Zn/Ni alloy layer, and at least one resin-covering layer positioned on top of this trivalent chromate layer, are successively formed on the surface of a steel material which either has or does not have a copper layer.

Furthermore, the third and fourth aspects that correspond to the above-described first and second aspects of the present inventions are that the invention relates to non-hexavalent-sacrificial (self-sacrificial) chromium type coating film structures in which in the above-described first and second aspect of the present invention, a metal layer, which has sacrificial (self-sacrificial) corrosion characteristics with respect to the steel material, e.g., a Zn and/or Zn-based alloy layer, is formed as an under layer of the Zn/Ni alloy layer.

Furthermore, the fifth aspect of the present invention is that it relates to a non-hexavalent-chromium type corrosion-resistant coating film structure which has a resin layer and a metal layer that is superior in terms of adhesion to the resin layer, and this structure is characterized in that:

a metal layer which has sacrificial corrosion characteristics with respect to the steel material and which has a metal component that can be replaced by the Ni component during chemical Ni plating in the subsequent process, e.g., a Zn and/or Zn-based alloy layer, a chemical Ni plating layer which is positioned on top of this metal layer (e.g., Zn and/or Zn-based alloy layer), and at least one resin-covering layer which is positioned on top of this chemical Ni plating layer, are successively formed on the surface of a steel material which either has or does not have a copper layer.

Furthermore, the sixth aspect of the present invention is that it relates to a non-hexavalent-chromium type corrosion-resistant coating film structure which has a resin layer and a metal layer that is superior in terms of adhesion to the resin layer, and this structure is characterized in that:

a metal layer which has sacrificial corrosion characteristics with respect to the steel material and which has a metal component that can be replaced by the Ni component during chemical Ni plating in the subsequent process, e.g., a Zn and/or Zn-based alloy layer, a chemical Ni plating layer which is positioned on top of this metal layer (e.g., Zn and/or Zn-based alloy layer), a trivalent chromate layer which is positioned on top of this chemical Ni plating layer, and at least one resin-covering layer which is positioned on top of this trivalent chromate layer, are successively formed on the surface of a steel material which either has or does not have a copper layer.

BEST MODE FOR CARRYING OUT THE INVENTION

The technical construction and embodiments of the present invention will be described in detail below.

In the present invention, the steel material used as a base material can be, for example, a steel material which has a copper layer on the surface (taking into account brazing that is performed during pipe manufacture in order to manufacture a double-wrapped steel pipe).

The steel material having the above-described corrosion-resistant coating film structure of the present invention is useful in many applications. Accordingly, the steel material used can be selected in connection with these applications.

For instance, examples of steel materials used in the present invention are indicated below according to designating symbols based on JIS or JASO. However, the present invention is not limited to these examples, and various types of steel materials as listed below can be used.

Pipe materials such as STKM, STAM, STS and TDW, etc.

Plate materials such as SPCC, SPCD, SPHC and SPHD, etc.

Wire materials such as SWRM, SWCH and SWRCH, etc.

(1) Formation of Zn and/or Zn-based Alloy Layer:

In the present invention (the inventions in claims 1 and 2), a Zn/Ni alloy layer is formed indispensably on the surface of the steel material.

However, a metal layer which has sacrificial (self-sacrificial) corrosion characteristics with respect to the steel material, e.g., a Zn and/or Zn-based alloy layer, can also be formed as an under layer in order to increase the corrosion resistance. This point will be explained below.

In the present invention, the formation of the above-described Zn and/or Zn-based alloy layer as the sacrificial (self-sacrificial) corrosion layer on the surface of the steel material can be accomplished by any desired method.

For example, such a Zn and/or Zn-based alloy layer can be formed as follows:

Zn→Electroplating is performed using a sulfuric acid bath according to an ordinary method, and Zn is electro-deposited to a thickness of 8 μm by passing current through at room temperature at a current density of 3 A/dm$^2$.

Zn/Ni→Electroplating is performed using a commercially marketed chloride bath, and Zn/Ni is electro-deposited to a thickness of 10 μm by passing current through for twelve minutes at 60° C. at a current density of 3 A/dm$^2$.

Zn/Fe→Using a commercially marketed alkali bath, Zn/Fe is electro-deposited to a thickness of 8 μm by passing current through at an ordinary temperature at a current density of 3 A/dm$^2$.

Zn/Al→Using molten plating, Zn/Al is deposited to a thickness of 8 μm.

In the present invention, the type and method of formation of the Zn and/or Zn-based alloy layer are not limited to the types and methods described above; and various types of Zn and/or Zn-based alloy layers and various formation methods can be used. For example, binary alloys such as Zn/Co or Zn/Ti, etc., or ternary alloys such as Zn/Al/Mg, etc. can be formed as Zn-base alloy layers by electroplating or molten plating, etc.

Furthermore, in the present invention, the thickness of the Zn and/or Zn-based alloy layer is generally set at 2 to 30 μm. However, from the standpoints of workability, corrosion resistance, productivity and economy, it is desirable that such thickness be 8 to 25 μm.

In the present invention, the metal layer having sacrificial (self-sacrificial) corrosion characteristics with respect to the above-described steel material is not limited to the above-described Zn and/or Zn-based alloy layer, and it goes without saying that such a layer can be formed also from Al, Mg, Cd or an alloy of such metals.

(2) Formation of Zn/Ni Alloy Layer:

In the present invention, the formation of a Zn/Ni alloy layer is essential from the standpoints of the growth of a micro-structure having a Zn/Ni alloy layer by a chemical treatment in the subsequent process, and the passivation (passive state) of the Zn/Ni alloy layer.

In the present invention, the inevitable formation of the Zn/Ni alloy layer can be accomplished by any desired method. For example, in cases where plating is used, a Zn/Ni alloy layer with an Ni co-deposition rate of 8 wt % can be electro-deposited to a thickness of 2 μm by using a commercially marketed chloride bath and causing current to pass through for 2 minutes at 60° C. at a current density of 3 A/dm$^2$.

In the present invention, the method used to form the Zn/Ni alloy layer is not limited to that described above. Various formation methods, including the use of a commercially marketed alkali bath, etc. can be used.

Furthermore, in the present invention, it is generally advisable to set the thickness of the Zn/Ni alloy layer at 1 to 10 μm. However, from the standpoints of workability, productivity and economy, a thickness of 2 to 5 μm is desirable.

In the present invention, the Ni content of the Zn/Ni alloy layer is generally 2 to 20 wt %. However, from the standpoints of workability, corrosion resistance, productivity and economy, an Ni content of 6 to 15 wt % is desirable. In particular, in cases where the Ni content is less than 2 wt %, it becomes difficult to obtain a fine crack structure; and in cases where the content exceeds 20 wt %, the workability drops conspicuously.

(3) Formation of de-Zn Layer:

In the present invention, the formation of the above-described de-Zn layer can be accomplished by subjecting the surface of the above-described Zn/Ni alloy layer to a chemical treatment.

For example, this de-Zn layer can be formed by performing an immersion treatment using a 1 v/v % aqueous solution of sulfuric acid, with the surface being immersed for 15 seconds at an ordinary temperature.

In the present invention, an aqueous solution other than the above-described aqueous solution of sulfuric acid can also be used as a treatment solution that is used to form the de-Zn layer, as long as this aqueous solution is capable of eluting (eliminating) Zn from the Zn/Ni alloy layer and oxidizing the Ni surface so as to form a passivation coating film layer. In particular, a sulfuric acid type solution is especially effective from the standpoints of ability to oxidize the Ni component and prevention of peeling (eliminating) of the Ni component during the de-Zn treatment.

As a result of the above-described de-Zn treatment, the micro-structure of the Zn/Ni alloy layer shows the conspicuous appearance of a fine indented and projecting structure, a fine groove structure or a fine crack structure in the surface of the layer when observed by an SEM. As a result, the anchoring effect increases, and the primary adhesion with the resin layer improves.

Furthermore, in the present invention, the above-described de-Zn treatment has the merit of simultaneously converting the surface layer of the Zn/Ni alloy layer into a passivation (passive state) layer. Accordingly, even if the resin layer that covers the surface of the Zn/Ni alloy layer is damaged by flying rocks, mud, etc. so that there is a corrosive attack on the Zn/Ni alloy layer by corrosive factors, corrosion can be effectively prevented by the above-described passivation layer, and as a result, the secondary adhesion can be improved in addition to the primary adhesion.

(4) Formation of Underlying Metal Layer for Chemical (Electroless) Ni Plating Layer:

In the present invention, a metal layer, which has sacrificial corrosion characteristics with respect to the steel material and which has a metal component that can be replaced by the Ni component in particular during chemical (electroless) Ni plating in the subsequent process, is formed as an underlying metal layer in connection with the formation of the chemical (electroless) Ni plating layer by chemical (electroless) Ni plating in the subsequent process.

This underlying metal layer has a micro-structure; and a sacrificial corrosion component is eluted while the surface is roughened during the chemical (electroless) Ni plating treatment, and the Ni component is substituted into the surface so that the adhesion to the resin layer is superior. More specifically, the underlying metal layer has a micro-structure that improves the anchoring (primary adhesion) and initial anti-rust properties (secondary adhesion) during the chemical (electroless) Ni plating treatment. It can be said that this corresponds to the formation of a de-Zn layer by the chemical treatment of the Zn/Ni alloy layer in the present invention.

The above-described metal layer, which has sacrificial corrosion characteristics with respect to the steel material and which has a metal component that can be replaced by the Ni component during the chemical (electroless) Ni plating in the subsequent process, can typically be formed by a Zn and or Zn-based alloy layer.

In addition, in the present invention, the above-described underlying metal layer can be formed by Al, Mg, Cd, an alloy of these metals, etc. Furthermore, in regards to the concrete method to form the above-described underlying layer, this layer can be formed in the same manner as in the method used to form the underlying layer of the Zn and/or Zn-based alloy layer described in the paragraphs of (1).

(5) Formation of Chemical (electroless) Ni Plating Layer:

The formation of the chemical (electroless) Ni plating layer in the present invention is accomplished by an ordinary chemical (electroless) plating method.

For example, an immersion treatment using an Ni Wood's bath can be performed, and a chemical (electroless) Ni plating layer can be formed by the immersion treatment for three seconds at an ordinary temperature.

Furthermore, in the present invention, the formation of the chemical (electroless) Ni plating layer is not limited to the above-described plating bath; and any bath, which contains therein an Ni component and which makes it possible to replace, for example, the Zn component in the surface of the underlying metal layer with the Ni in the bath, can be used.

In the present invention, an (electroless) chemical Ni plating layer is formed as an upper layer on top of the underlying metal layer (e.g., Zn and/or Zn-based alloy layer). The formation of this chemical (electroless) Ni plating layer is important for the reasons below:

(a) As a result of the chemical (electroless) Ni plating treatment, the Zn component is eluted while the surface of the underlying Zn and/or Zn-based alloy layer is roughened, and an Ni component is substituted into this surface. Accordingly, as in the formation of the de-Zn layer in the above-described paragraphs in (3), the surface and the chemical (electroless) Ni plating layer itself form a fine crack structure, so that the anchoring effect increases, thus making it possible to improve the primary adhesion to the resin layer.

(b) Furthermore, as in the formation of the de-Zn layer in the above-described paragraphs in (3), the chemical (electroless) Ni plating treatment makes it possible to achieve the simultaneous oxidation of the Ni substitution layer and chemical Ni plating layer by a subsequent treatment of rinsing and drying, etc., so that a passivation coating film layer can be formed. Accordingly, even if the resin layer covering the surface of the Ni substitution layer and chemical Ni plating layer is damaged by flying rocks, mud, etc. so that there is a corrosive attack on the Ni substitution layer and chemical Ni plating layer by corrosive factors, corrosion can be effectively prevented by the passivation coating film layer. Thus, the secondary adhesion can be improved in addition to the primary adhesion.

(6) Formation of Trivalent Chromate Layer:

The formation of this trivalent chromate layer is substituted for the conventional hexavalent chromate layer (which places a high burden on the environment).

In the present invention, the formation of the trivalent chromate layer has an important significance similar to that of the formation of the de-Zn layer in the above-described paragraphs in (3). More specifically, the formation of such a trivalent chromate layer on top of the underlying Zn/Ni alloy layer in the present invention makes the micro-structure of the underlying Zn/Ni alloy layer more evident during the trivalent chromate treatment and also effects passivation, so that the primary and secondary adhesion to the resin layer are improved.

Furthermore, in the present invention, the formation of this trivalent chromate layer is important from the standpoint of the passivation of the underlying chemical (electroless) Ni plating layer and prevention of the peeling (eliminating) of the Ni component.

In the present invention, a sulfuric acid type chromate treatment solution containing only trivalent chromium ions is effective as the trivalent chromate treatment solution.

Furthermore, in the present invention, the trivalent chromate layer can be formed by performing an immersion treatment using a trivalent chromate treatment solution based on, for example, a sulfuric acid system; and a trivalent chromate layer is formed by the immersion treatment for 15 seconds at an ordinary temperature.

(7) Formation of Resin Covering Layer:

In the corrosion-resistant coating film structure of the present invention, the resin coating layer constitutes the outermost layer.

In the present invention, one or more resin covering layers are formed using the same or different types of resins.

Examples of resin components and resin covering film formation methods are shown below.

PVF (polyvinyl fluoride)→A covering layer with a thickness of 20 μm is formed by immersion method (dipping).

PVdF (polyvinylidene fluoride)→A covering layer with a thickness of 20 μm is formed by coating method (coating material blowing coating method).

PA11 (polyamide 11)→A covering layer with a thickness of 20 μm is formed by extrusion coating method.

PA12 (polyamide 12)→A covering layer with a thickness of 80 μm is formed by coating method (powder blowing coating method).

In the present invention, besides the above-described resin components, various types of resin components can be selected in accordance with the intended purpose as the resin components that form the resin covering layer(s).

Furthermore, in the present invention, the formation of the resin covering layer(s) can be accomplished using any desired system. For example, the resin covering layer(s) can be formed by desired methods such as immersion methods (dipping methods), coating methods (coating material or powder blowing coating methods), (co)extrusion coating methods, etc. Furthermore, the thickness of the resin covering layer(s) can also be set as desired in accordance with the intended purpose.

EMBODIMENTS

Below, the present invention will be described in greater detail in terms of its examples and comparative examples.

It goes without saying that the present invention is not limited to the examples described below.

The specimens in the respective Examples of the present invention and Comparative examples were prepared by continuously performing the following treatment processes:

Degreasing treatment of steel material→first plating→second plating→chemical treatment (de-Zn treatment or trivalent chromate treatment)→resin covering.

However, some steps were omitted depending on the Examples and Comparative examples involved.

Furthermore, the degreasing treatment of the steel material was performed by a PR method using an alkali degreasing solution.

Rinsing with water was performed in the respective treatment processes. Following the chemical treatment, the specimens were dried by using an air blower to blow away the moisture, and the resin covering treatment was performed after this treatment.

The specimens in the respective Examples and Comparative examples prepared by the respective treatment processes has the following corrosion-resistant coating film structure: steel material, first plating layer, second plating layer, chemically treated layer, and resin covering layer(s). The respective constituent components of the structure were selected singly from the components described below.

The types of constituent components and formation methods of the structures are shown below.

<Steel Material>

STKM (JIS G 3445 carbon steel pipe for mechanical structures)→size ϕ8.0×L 300×t 0.7 (mm)

TDW (JASO M101 metal pipe for automobile piping, double wrapped steel pipe)→size ϕ8.0×L 300×t 0.7 (mm)

SPCC (JIS G 3141 cold-rolled steel plates and steel belts)→size W 50×L 100×t 1.0 (mm)

SWRM (JIS G 3505 soft steel wire material)→size ϕ10×L 100 (mm)

<First Plating Layer (Zn and/or Zn-based Alloy Layer)>

Zn→Zn with a thickness of 8 μm was electro-deposited by performing electroplating using an ordinary sulfuric acid bath, with current passed through for ten minutes at room temperature at a current density of 3 A/dm$^2$.

Zn/Ni→Zn/Ni with a thickness of 10 μm was electro-deposited using a commercially marketed chloride bath by passing current through for twelve minutes at 60° C. at a current density of 3 A/dm$^2$.

Zn/Fe→Zn/Fe with a thickness of 8 μm was electro-deposited using a commercially marketed alkali bath by passing current through for 20 minutes at an ordinary temperature at a current density of 3 A/dm$^2$.

Zn/Al→Zn/Al with a thickness of 8 μm was deposited using molten plating.

<Second Plating Layer (Zn/Ni Alloy Layer or Chemical Ni Plating Layer)>

Zn/Ni→Zn/Ni with a thickness of 2 μm and an Ni co-deposition rate of 8 wt % was electro-deposited using a commercially marketed chloride bath by passing current through for two minutes at 60° C. at a current density of 3 A/dm$^2$.

Chemical Ni plating layer→An immersion treatment was performed using an Ni Wood's bath, and a chemical (electroless) Ni plating layer was formed by the immersion treatment for three seconds at an ordinary temperature.

<Chemically Treated Layer>

De-Zn layer→An immersion treatment was performed using a 1 v/v % aqueous solution of sulfuric acid, and a de-Zn layer was formed by the immersion treatment for 15 seconds at an ordinary temperature.

Trivalent chromate layer→An immersion treatment was performed using a trivalent chromate treatment solution based on a sulfuric acid system, and a trivalent chromate layer was formed by the immersion treatment for 15 second at an ordinary temperature.

<Resin Covering Layer>

PVF→Covering to a thickness of 20 μm by immersion method (dipping method).

PVdF→Covering to a thickness of 20 μm by coating method (coating material blowing coating method).

PA11→Covering to a thickness of 20 μm by extrusion coating method.

PA12 →Covering to a thickness of 80 μm by coating method (powder blowing coating method).

EXAMPLE 1

A specimen was prepared by selecting and combining the following materials:

Steel material: SPCC
First plating layer: Zn/Ni alloy layer
Second plating layer omitted
Chemically treated layer: de-Zn layer
Resin covering layer: PVF layer

EXAMPLE 2

A specimen was prepared by selecting and combining the following materials:

Steel material: TDW
First plating layer: Zn/Ni alloy layer
Second plating layer omitted
Chemically treated layer: trivalent chromate layer
Resin covering layer: PA11 layer

EXAMPLE 3

A specimen was prepared by selecting and combining the following materials:

Steel material: SWRM
First plating layer: Zn layer
Second plating layer: Zn/Ni alloy layer
Chemically treated layer: de-Zn layer
Resin covering layer: PA12 layer

EXAMPLE 4

A specimen was prepared by selecting and combining the following materials:

Steel material: TDW
First plating layer: Zn layer
Second plating layer: Zn/Ni alloy layer
Chemically treated layer: trivalent chromate layer
Resin covering layer: PVF layer

EXAMPLE 5

A specimen was prepared by selecting and combining the following materials:

Steel material: STKM
First plating layer: Zn layer
Second plating layer: chemical Ni plating layer
Chemically treated layer omitted
Resin covering layer: PA11 layer

EXAMPLE 6

A specimen was prepared by selecting and combining the following materials:
Steel material: SPCC
First plating layer: Zn layer
Second plating layer: chemical Ni plating layer
Chemically treated layer: trivalent chromate layer
Resin covering layer: PVdF layer

EXAMPLE 7

A specimen was prepared by selecting and combining the following materials:
Steel material: TDW
First plating layer: Zn/Fe alloy layer
Second plating layer: Zn/Ni alloy layer
Chemically treated layer: de-Zn layer
Resin covering layer: PVdF layer

EXAMPLE 8

A specimen was prepared by selecting and combining the following materials:
Steel material: SWRM
First plating layer: Zn/Fe alloy layer
Second plating layer: Zn/Ni alloy layer
Chemically treated layer: trivalent chromate layer
Resin covering layer: PA12 layer

EXAMPLE 9

A specimen was prepared by selecting and combining the following materials:
Steel material: SPCC
First plating layer: Zn/Fe alloy layer
Second plating layer: chemical Ni plating layer
Chemically treated layer omitted
Resin covering layer: PVF layer

EXAMPLE 10

A specimen was prepared by selecting and combining the following materials:
Steel material: STKM
First plating layer: Zn/Fe alloy layer
Second plating layer: chemical Ni plating layer
Chemically treated layer: trivalent chromate layer
Resin covering layer: PA11 layer

EXAMPLE 11

A specimen was prepared by selecting and combining the following materials:
Steel material: STKM
First plating layer: Zn/Al alloy layer
Second plating layer: Zn/Ni alloy layer
Chemically treated layer: de-Zn layer
Resin covering layer: PA11 layer

EXAMPLE 12

A specimen was prepared by selecting and combining the following materials:
Steel material: TDW
First plating layer: Zn/Al alloy layer
Second plating layer: Zn/Ni alloy layer
Chemically treated layer: trivalent chromate layer
Resin covering layer: PVdF layer

EXAMPLE 13

A specimen was prepared by selecting and combining the following materials:
Steel material: SWRM
First plating layer: Zn/Al alloy layer
Second plating layer: chemical Ni plating layer
Chemically treated layer omitted
Resin covering layer: PA12 layer

EXAMPLE 14

A specimen was prepared by selecting and combining the following materials:
Steel material: SPCC
First plating layer: Zn/Al alloy layer
Second plating layer: chemical Ni plating layer
Chemically treated layer: trivalent chromate layer
Resin covering layer: PVF layer

COMPARATIVE EXAMPLE 1

A specimen was prepared by selecting and combining the following materials:
Steel material: TDW
First plating layer: Zn layer
Second plating layer omitted
Chemically treated layer omitted
Resin covering layer: PVF layer

COMPARATIVE EXAMPLE 2

A specimen was prepared by selecting and combining the following materials:
Steel material: SPCC
First plating layer: Zn layer
Second plating layer omitted
Chemically treated layer: trivalent chromate layer
Resin covering layer: PVdF layer

COMPARATIVE EXAMPLE 3

A specimen was prepared by selecting and combining the following materials:
Steel material: STKM
First plating layer: Zn/Al alloy layer
Second plating layer omitted
Chemically treated layer omitted
Resin covering layer: PA11 layer

COMPARATIVE EXAMPLE 4

A specimen was prepared by selecting and combining the following materials:
Steel material: SWRM
First plating layer: Zn/Al alloy layer
Second plating layer omitted Chemically treated layer omitted
Resin covering layer: PA12 layer (Evaluation Method 1 for Specimens in Respective Examples of the Present Invention and Comparative Examples: Surface Conditions)

For the respective Examples of the present invention and Comparative examples, the surface conditions of the uppermost layer of the metal layer were observed under magnification by an SEM (scanning electron microscope) prior to the resin covering treatment, and the presence or absence of indentations/projections and cracks was evaluated using the following three grades:

○→conspicuously visible
Δ→slightly visible
X→almost invisible (Evaluation Method 2 for Specimens in Respective Examples of the Present Invention and Comparative Examples: Primary Adhesion)

Immediately following the resin covering treatment in the respective Examples of the present invention and Comparative examples, checkerboard cuts (4×4 masses, 1 mm square) reaching the steel material were formed in the specimen surface using a cutter knife, and a peeling test of the checkerboard portions was performed using cellophane tape. The primary adhesion was evaluated using the following two grades:

○→Not even a single mass of the resin covering layer was peeled
X→One ore more masses of the resin covering film were peeled (Evaluation Method 3 for Specimens in Respective Examples of the Present Invention and Comparative Examples: Secondary Adhesion)

Immediately following the resin covering treatment in the respective Examples of the present invention and Comparative examples, checkerboard cuts (4×4 masses, 1 mm square) reaching the steel material were formed in the specimen surface using a cutter knife, and the checkerboard portions were immersed for 100 hours in a brine solution with a concentration of 5 wt % at 50° C. Afterward, the specimens were dried, and a peeling test of the checkerboard portions was performed using cellophane tape. The secondary adhesion was evaluated using the following two grades:

○→Not even a single mass of the resin covering layer was peeled
X→One ore more masses of the resin covering film were peeled The evaluation results are summarized in Table 1.

TABLE 1

| | Construction | | | | | Evaluation results | | |
|---|---|---|---|---|---|---|---|---|
| | Steel material | First plating layer | Second plating layer | Chemically treated layer | Resin layer | Surface conditions | Primary adhesion | Secondary adhesion |
| Example 1 | SPCC | Zn/Ni | — | de-Zn | PVF | ○ | ○ | ○ |
| Example 2 | TDW | Zn/Ni | — | Trivalent chromate | PA11 | ○ | ○ | ○ |
| Example 3 | SWRM | Zn | Zn/Ni | de-Zn | PA12 | ○ | ○ | ○ |
| Example 4 | TDW | Zn | Zn/Ni | Trivalent chromate | PVF | ○ | ○ | ○ |
| Example 5 | STKM | Zn | Chemical Ni | — | PA11 | ○ | ○ | ○ |
| Example 6 | SPCC | Zn | Chemical Ni | Trivalent chromate | PVdF | ○ | ○ | ○ |
| Example 7 | TDW | Zn/Fe | Zn/Ni | de-Zn | PVdF | ○ | ○ | ○ |
| Example 8 | SWRM | Zn/Fe | Zn/Ni | Trivalent chromate | PA12 | ○ | ○ | ○ |
| Example 9 | SPCC | Zn/Fe | Chemical Ni | — | PVF | ○ | ○ | ○ |
| Example 10 | STKM | Zn/Fe | Chemical Ni | Trivalent chromate | PA11 | ○ | ○ | ○ |
| Example 11 | STKM | Zn/Al | Zn/Ni | de-Zn | PA11 | ○ | ○ | ○ |
| Example 12 | TDW | Zn/Al | Zn/Ni | Trivalent chromate | PVdF | ○ | ○ | ○ |
| Example 13 | SWRM | Zn/Al | Chemical Ni | — | PA12 | ○ | ○ | ○ |
| Example 14 | SPCC | Zn/Al | Chemical Ni | Trivalent chromate | PVF | ○ | ○ | ○ |
| Comparative example 1 | TDW | Zn | — | — | PVF | Δ | x | x |
| Comparative example 2 | SPCC | Zn | — | Trivalent chromate | PVdF | x | x | x |
| Comparative example 3 | STKM | Zn/Al | — | — | PA11 | Δ | x | x |
| Comparative example 4 | SWRM | Zn/Al | — | — | PA12 | Δ | x | x |

As seen from Table 1, indentations/projections or cracks were conspicuously visible in the uppermost surface layer of the metal layer in all of the Examples that satisfy the technical conditions of the present invention; and an anchoring effect was exhibited, and the primary adhesion was good. In addition, the corrosion rate was governed by the passivation treatment of the surface of the uppermost layer of the metal layer, so that the secondary adhesion was also good.

In all of the Comparative examples, on the other hand, indentations/projections or cracks were only slightly visible, or almost invisible, in the uppermost surface layer of the metal layer, so that the primary adhesion was poor. In addition, the uppermost surface layer of the metal layer was easily corroded, and the secondary adhesion was also poor.

INDUSTRIAL APPLICABILITY

The present invention provides a coating layer structure that has a specified metal layer and resin layer on the surface of a steel material and has a superior corrosion resistance. In the present invention, the fine micro-structure (fine indented/projecting structure, fine groove structure, or fine crack structure) of the surface of the above-described specified metal layer is adjusted in terms of the joint so that the primary adhesion to the resin layer is improved. Accordingly, the corrosion resistance and primary adhesion are superior to those of conventional structures. In addition, the surface of the metal layer is subjected to passivation so that a passivation coating film is formed. Accordingly, the corrosion rate is governed by this passivation film so that the secondary adhesion is improved. Consequently, the corrosion resistance and secondary adhesion are superior to those of conventional structures.

Furthermore, a structure which has a hexavalent chromium type chromate layer and a resin layer has been known in the past as a corrosion-resistant coating film structure of this type. However, from the standpoint of burden on the environment, the use of a trivalent chromium type chromate layer in place of hexavalent chromium (which places a high burden on the environment) has been proposed. Nonetheless, a trivalent chromate layer suffers from the drawback of insufficient adhesion to resin layers.

In this regard, the corrosion-resistant coating film structure according to the present invention is advantageous in that superior adhesion is obtained even though a trivalent chromate layer is used. Accordingly, the present invention increases the value of utilizing a trivalent chromate layer in place of a hexavalent chromate layer.

Steel materials (pipe materials, plate materials, wire materials, etc.) that have the corrosion-resistant coating film structure of the present invention can be used in various applications as a result of the superior corrosion resistance of these steel materials. Thus, the present invention has great industrial value.

The invention claimed is:

1. A corrosion-resistant coating film structure which contains no hexavalent chromium, wherein said corrosion-resistant coating film structure consists essentially of:

1) a metal layer which has a self-sacrificial corrosion characteristic with respect to steel,
2) a Zn/Ni alloy layer having a fine crack structure provided on top of said metal layer,
3) at least one layer consisting of trivalent chromate and free of hexavalent chromate provided on top of said Zn/Ni alloy layer, and
4) at least one resin covering layer which is provided on top of said trivalent chromate layer, successively formed on a surface of a product made of steel which is with or without a copper layer.

2. The corrosion-resistant coating film structure according to claim 1, wherein said metal layer which has self-sacrificial corrosion characteristic with respect to said steel is selected from the group consisting of a Zn and Zn-based alloy layer.

3. A corrosion-resistant coating film structure which contains no hexavalent chromium, wherein said corrosion-resistant coating film structure consists essentially of:

1) a metal layer which has a self-sacrificial corrosion characteristic with respect to steel and has a metallic element that is replaced by Ni during electrolessly Ni plating in a subsequent process,
2) electrolessly plated Ni layer having a fine crack structure is provided on top of said metal layer, and
3) at least one resin covering layer which is provided on top of said electrolessly plated Ni layer, successively formed on a surface of a product made of steel.

4. A corrosion-resistant coating film structure which contains no hexavalent chromium, wherein said corrosion-resistant coating film structure consists essentially of:

1) a metal layer which has a self-sacrificial corrosion characteristic with respect to steel and has a metallic element that is replaced by Ni during electrolessly Ni plating in a subsequent process,
2) an electrolessly plated Ni layer having a fine crack structure is provided on top of said metal layer,
3) at least one layer consisting of trivalent chromate and free of hexavalent chromate provided on top of said electrolessly plated Ni layer, and
4) at least one resin covering layer which is provided on top of said trivalent chromate layer, successively formed on a surface of a product made of steel.

5. The corrosion-resistant coating film structure according to claim 3 or 4, wherein said metal layer which has a self-sacrificial corrosion characteristic with respect to steel and has a metallic element that is replaced by Ni during electrolessly Ni plating in a subsequent process, is selected from the group consisting of a Zn and Zn-based alloy layer.

6. The corrosion-resistant coating film structure according to claim 3 or 4, wherein said surface of said product made of steel has a copper layer.

* * * * *